United States Patent [19]

Haedrich et al.

[11] 4,376,403

[45] Mar. 15, 1983

[54] FLUTE

[75] Inventors: Walter Haedrich, 802 41st St., Moline, Ill. 61265; J. Dennis Lawson, Davenport, Iowa

[73] Assignee: Walter Haedrich, Moline, Ill.

[21] Appl. No.: 259,755

[22] Filed: May 1, 1981

[51] Int. Cl.[3] ..... G10D 9/04

[52] U.S. Cl. ..... 84/384; 84/380 R

[58] Field of Search ..... 84/380 R, 382, 384, 84/385 R, 386

[56] References Cited

U.S. PATENT DOCUMENTS 901,913 10/1908 Julliot ..... 84/384
1,586,794 6/1926 Gage .
2,419,874 4/1947 Berkson .

FOREIGN PATENT DOCUMENTS 317433 2/1903 France .
88410 12/1966 France ..... 84/384

OTHER PUBLICATIONS

Nancy Toff—The Development of the Modern Flute—1979, including pp. 131 through 137 and 163 through 165.

*Primary Examiner*—Lawrence R. Franklin
*Attorney, Agent, or Firm*—Henderson & Sturm

[57] ABSTRACT

The flute invention relates to fingering mechanisms. More readily attained and maintained technical competence in playing the flute is enabled by facilitator mechanism (13) for improved actuation of the B flat key. Facilitator mechanism (14) includes a rocker bar (54) coupling the Briccialdi B flat lever to the rod assembly sections carrying the B flat key and the G key. Coupling between the G sharp lever and the B flat key is maintained by cam (67, 81) and plate (68, 82).

7 Claims, 8 Drawing Figures

FLUTE

TECHNICAL FIELD

This invention relates to flutes. More particularly, the invention relates to modification of the finger mechanisms of the standard Boehm flute.

BACKGROUND OF THE INVENTION

The earlier history of the flute is that of the "German" or "old system" flute. Such flutes generally were wooden and, by the start of the nineteenth century, had eight keys. Nevertheless, a wide variety of flutes commonly were in use, having one, to as many as seventeen, keys; and many fingering systems (the manner in which the player engages the keys with his fingers) also were employed.

As the typical orchestra evolved from a chamber orchestra type into the full symphony orchestra, many defects of the flute became apparent. The wooden German flute had uncertain intonation, tone which was relatively weak and readily lost in the full symphony orchestra sound, and fingering systems not up to the task of playing the more complex music being written.

Theobald Boehm, working in the 1830's and 1840's, and particularly through his 1847 flute, developed the modern, cylindrical flute, finger mechanism and fingering system. With the addition of the Briccialdi B flat thumb lever, the Boehm flute and fingering system are today's standards.

Attempts have been made to improve the Boehm flute. Gage, in U.S. Pat. No. 1,586,794, provided a mechanism whereby depressing the G or E keys would elevate the B flat key while the thumb was on the Briccialdi B flat lever. Julliot, in French Patent No. 317,433, addressed the sounding of high F sharp; awkward connections such as high F sharp to A, and high F to A, called fork fingerings; and difficult trill fingerings originating with G sharp.

A most vexing problem of the Boehm flute and fingering system is movement of the left hand thumb to and between the B flat and B natural levers, most particularly when high F sharp or high B natural is to be played. A very common mistake, particularly for beginning students, is the failure to move the thumb from B flat lever down position to the B natural lever down position when attempting to play high F sharp or high B natural.

DISCLOSURE OF INVENTION

This invention provides fingering mechanisms for actuating the B flat key of a Boehm flute. A facilitator assembly couples the Briccialdi B flat lever to the main support rod and sleeve assembly. The facilitator assembly has a rocker bar pivotally attached between an extension of the G key foot and a lever connected to the main support rod and sleeve assembly adjacent the B flat key. A second facilitator assembly couples the G sharp lever to the main support rod and sleeve assembly adjacent the right hand B flat lever.

Depression of the G key lifts the B flat key from the tone hole when the Briccialdi B flat lever is down, such that high F sharp or high B natural can be played. Depression of the G sharp lever depresses the B flat key, such that the A flat-B flat trill is retained. The Boehm fingering system is retained except for elimination of a very troublesome thumb movement.

It is an object of this invention to provide an improvement to the Boehm flute and fingering system.

Also an object of this invention is provision of a flute finger mechanism whereby improvement of the technical abilities of flute players is facilitated, time required to be spent by players in mechanical practicing of fingerings is reduced, and time available to players for artistic pursuits is increased.

Another object of this invention is provision of a flute with improved finger mechanism for actuation of the B flat key.

It is also an object of this invention to provide flute finger mechanism whereby playing high F sharp or high B natural is facilitated and the A flat-B flat trill is maintained.

A further object is provision of a finger mechanism whereby the aforementioned objects are attained, while the standard Boehm fingering system is maintained except for elimination of a troublesome finger movement.

An object of this invention is provision of a finger mechanism neither heavy nor bulky such as to distract flutists, readily integrated into the Boehm flute at modest cost, durable, and capable of achieving the aforementioned objects.

These objects and other features and advantages of the flute invention will become readily apparent upon referring to the following description and drawings.

BRIEF DESCRIPTION OF DRAWINGS

The flute of this invention is illustrated in the drawings wherein.

BEST MODE FOR CARRYING OUT THE INVENTION

Figure 1:
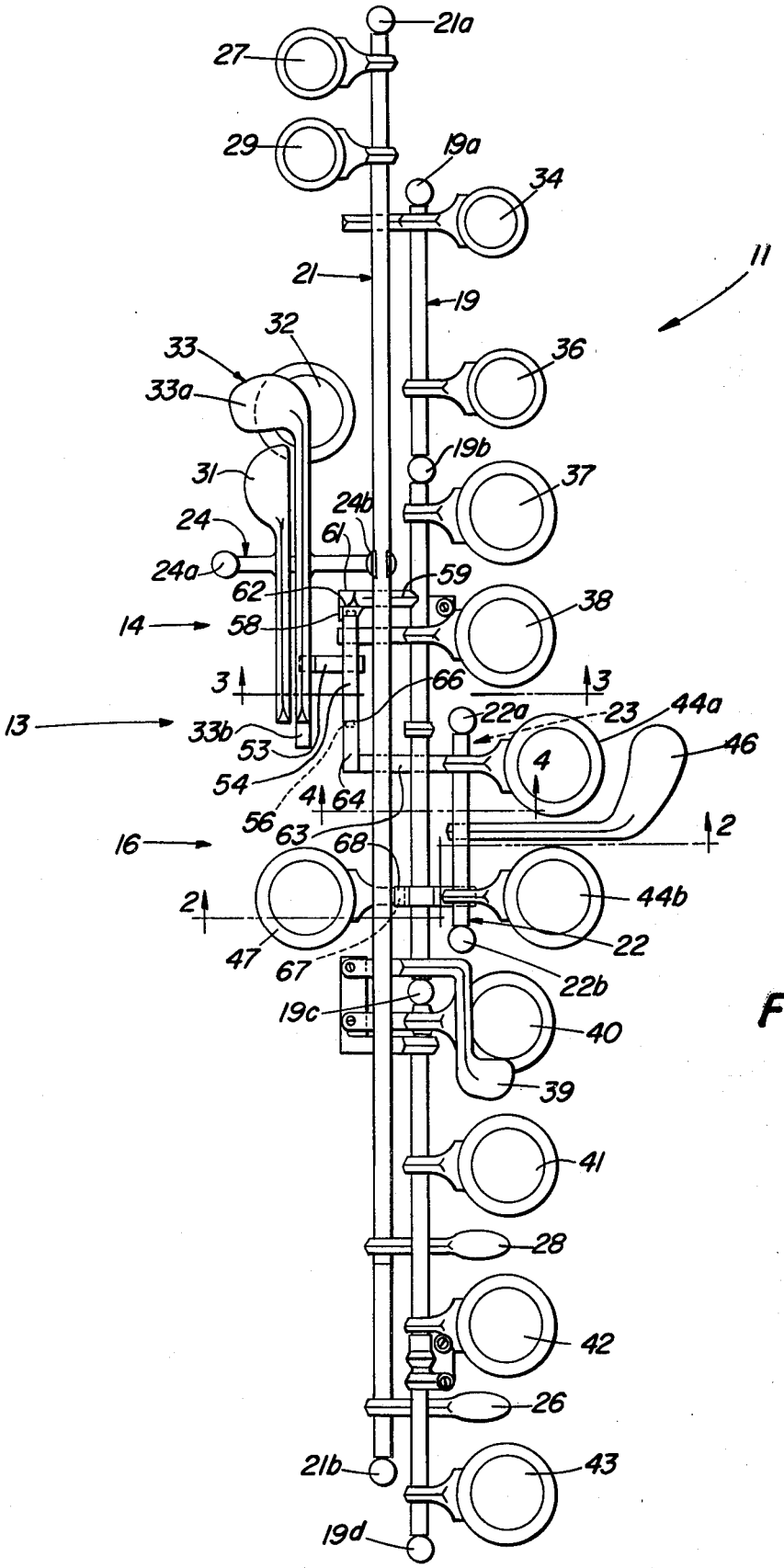
FIG. 1 is a shematic view of the fingering mechanisms of the middle portion or main body of the flute with offset G keys.
Figure 5:
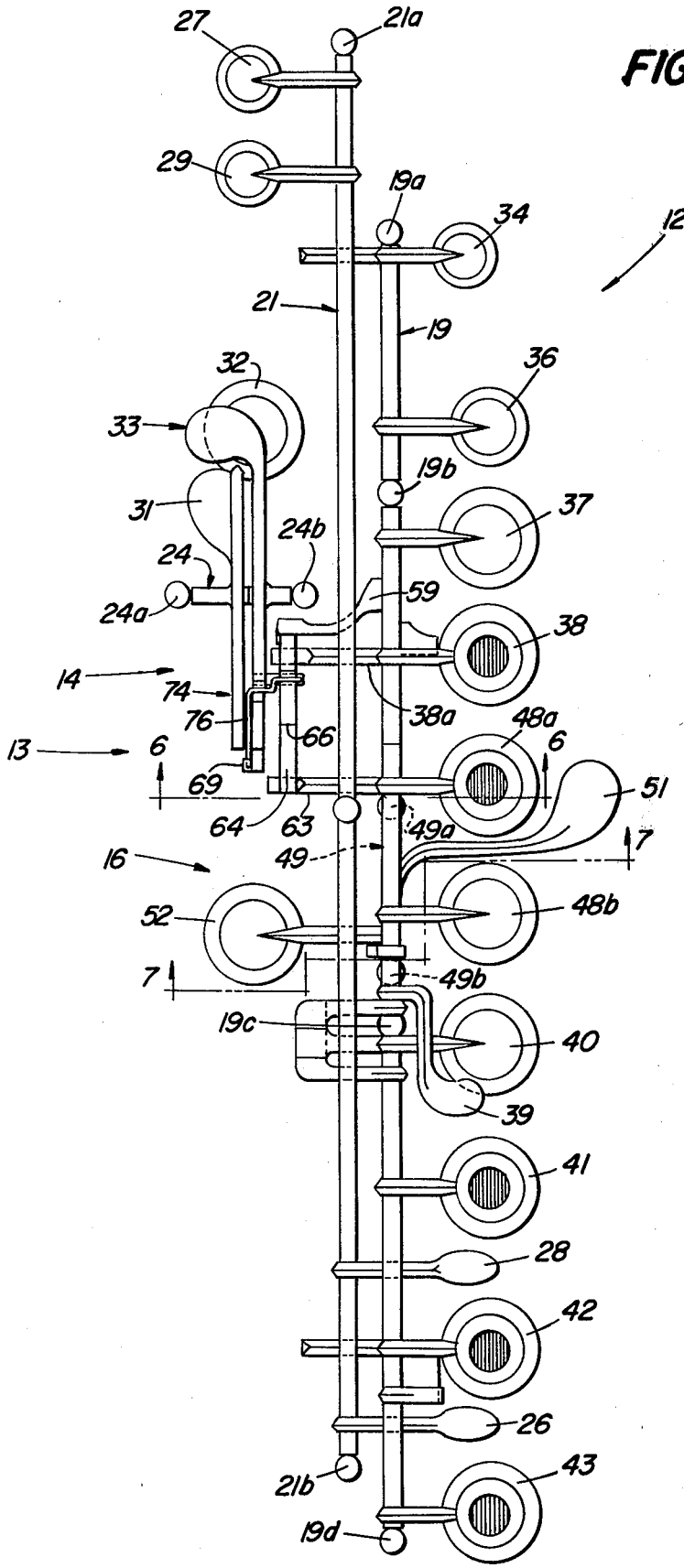
FIG. 5 is a schematic view of the fingering mechanisms for the flute with in-line G keys.

Flute key mechanisms are shown generally at 11 in FIG. 1 for the offset type Boehm system flute, and at 12 in FIG. 5 for the in-line type Boehm flute. The facilitator invention is shown generally at 13 and more particularly includes an high F sharp/high B natural facilitator assembly 14 and an A flat-B flat trill facilitator assembly 16. As this invention is concerned with the upper part of the middle section of a standard Boehm flute, neither the head joint with embouchure nor the foot joint are shown or described herein.

Figure 2:
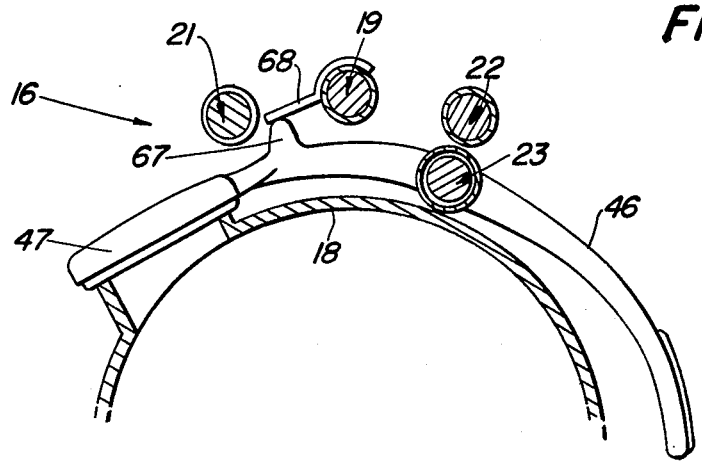
FIG. 2 is an enlarged, fragmentary cross sectional view taken along line 2—2 of FIG. 1, showing A flat-B flat trill facilitator mechanism.
Figure 3:
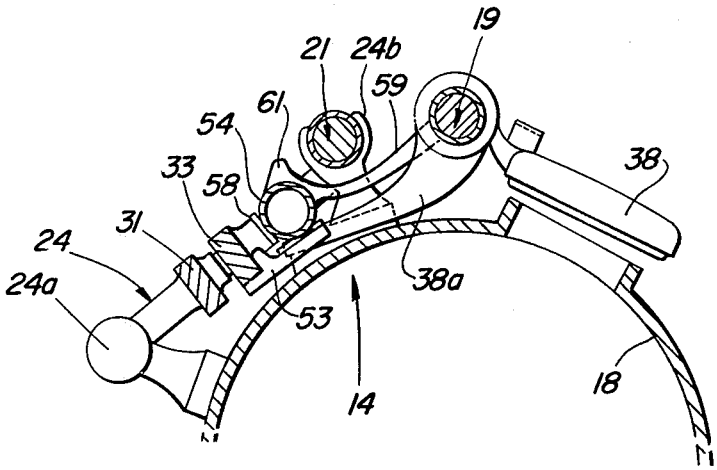
FIG. 3 is an enlarged, fragmentary cross sectional view taken along line 3—3 of FIG. 1, showing high F sharp/high B natural facilitator mechanism.
Figure 4:
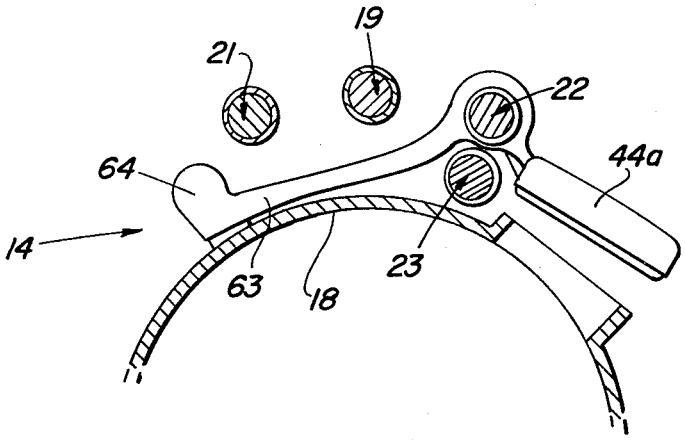
FIG. 4 is an enlarged, fragmentary cross sectional view taken along line 4—4 of FIG. 1.

The offset Boehm flute includes a cylindrical tube 18 (FIGS. 2–4) through which are formed a plurality of tone holes. A main support rod and sleeve assembly 19 is mounted parallel to the long axis of tube 18 by posts 19*a*, 19*b*, 19*c*, 19*d* fixed to the tube 18. A trill rod and sleeve assembly 21 similarly is mounted between posts 21*a*, 21*b*. Upper and lower supplementary rod and sleeve assemblies 22, 23 similarly are mounted between posts 22*a*, 22*b*. A transverse rod and sleeve assembly 24 extends between post 24*a* and saddle post 24*b*, the latter also providing additional support for trill rod 21.

Fixed adjacent opposite ends of trill assembly 21 are the D sharp trill lever 26 and the D sharp trill key 27. The D trill lever 28 and D trill key 29 are carried by trill assembly 21 adjacent lever 26 and key 27 respectively. Construction and operation of the Boehm flute trill rod and sleeve assembly is well known to those skilled in the art and will not be described further.

Pivoted on assembly 24 is the B natural lever 31 which carries at one end the key 32 for covering the normally open B tone hole. The Briccialdi B flat lever 33 is pivoted upon rod 24 and has a spatula end 33*a* extending over key 32 and an opposite free end 33*b*.

The C-key 34 and spatula 36 therefor are fixed to the rod and sleeve assembly 19 section rotatably mounted between posts 19*a*, 19*b*. To the assembly 19 section mounted between posts 19*b*, 19*c* are attached to the B flat key 37, A key 38 and B flat lever 39. The F sharp, F, E and D keys 40, 41, 42, 43 are attached to the assembly 19 section extending between posts 19*c*, 19*d*.

The paired G keys 44*a*, 44*b* are attached to the upper rod and sleeve assembly 22.

The G sharp lever 46 and G sharp key 47 are attached to the lower rod and sleeve assembly 23.

Figure 6:
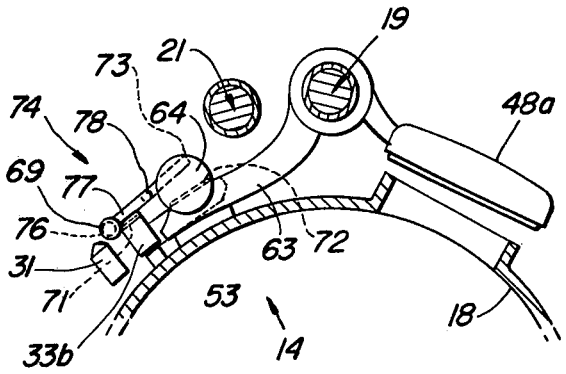
FIG. 6 is an enlarged fragmentary cross sectional view taken along line 6—6 of FIG. 5, showing high F sharp/high B natural facilitator mechanism.

The in-line Boehm flute (FIGS. 5–7) differs from the foregoing in that the G keys 48*a*, 48*b* are attached to the main rod and sleeve assembly 19 between the A key 38 and B flat lever 39. A supplementary rod and sleeve assembly 49 is fixed by posts 49*a*, 49*b* to the tube 18 below assembly 19. The assembly 49 extends from adjacent the upper G key 48*a*, past the lower G key 48*b*, to adjacent the B flat lever 39. The G sharp lever 51 and G sharp key 52 are carried by assembly 49.

The manner of attachment of the various keys and levers and their interaction to open and close various tone holes are well known to those of ordinary skill in the arts of manufacturing and playing the standard Boehm flute, and, therefore, will not be described further herein. The facilitator invention 13 alters the Boehm system's manner of actuation of the B flat key 37 without adding fingerings to the conventional fingering system.

Figure 8:
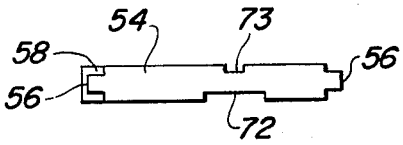
FIG. 8 is an enlarged, side elevational view of the rocker bar.

A high F sharp/B natural facilitator (FIGS. 1, 3 and 4) assembly 14 includes a foot 53 fixed to the underside of the B flat lever 33, between the pivot at transverse rod and sleeve assembly 24 and the free end 33*b*. An elongated, cylindrical rocker bar 54 has at each end thereof a mounting pin 56 (see also FIG. 8). The rocker bar 54 also has a flat flange 58 contiguous with the exterior surface, parallel to the long axis, and extending beyond one end, of the bar 54.

A curved support 59 (FIG. 3) extends from the exterior of assembly 19, adjacent A key 38, between the B flat and A keys 37, 38. The support 59 curves beneath trill assembly 21 and terminates in a pivot bearing 61. A shoulder area 62 is formed on the pivot bearing 61 and faces toward lever 33 (FIG. 1).

The foot of the G key 44*a* (see FIG. 4) includes an extension 63. A cylindrical member 64, at one end thereof, is mounted on the extension 63 and extends therefrom parallel to assemblies 19, 21. The member 64 terminates at a free end, with a pivot bearing 66, extended toward the pivot bearing 61.

The rocker bar 54 is mounted by inserting the pins 56 into the pivot bearings 61, 66. The rocker bar 54 thereby is mounted above the foot 53. The foot 38*a* of the A key 38 also extends beneath the rocker bar 54 (see FIG. 3). The shoulder area 62 receives the flat flange 58.

The A flat-B flat trill facilitator 16 (FIG. 2) includes a cam 67 formed on the support arm of the G sharp key 47. The cam 67 extends away from the tube 18. A plate 68 is fixed to the exterior of assembly 19, directly over the cam 67 on the G sharp key 47 support arm, and extends toward trill assembly 21.

The standard biasing springs (not shown) for the B flat key 37 and the upper G key 44*a* are selected such that the B flat key 37 biasing spring is weaker or lighter than the G key 44*a* biasing spring.

For the in-line Boehm flute 12 (FIGS. 5, 6 and 7), the facilitator assembly 14 includes a flange or bracing receptacle 69 fixed at free end 33*b* and to the side of lever 33 facing lever 31. A transverse notch 71 is cut into the top side of lever 33, between end 33*b* and foot 53.

An underside transverse notch 72 (see FIG. 8) is cut into rocker bar 54, intermediate pins 56, and the foot 53 is received in the notch 72. A top side transverse notch 73 is cut into the rocker bar 54, and this notch 73 also is intermediate the ends of the rocker bar 54.

A spring 74 is provided. A longitudinal section 76 is fitted into the bracing receptacle 69 and extends therefrom generally parallel to, and between, levers 31, 33. The spring 74 then bends at a first transverse section 77 which is received by the notch 71. Another bend results in a shorter longitudinal section 78 extending generally parallel to, and between, lever 33 and rocker bar 54. The spring 74 then bends to form a second transverse section 79 which is received by the notch 73, directly over the foot 53.

Figure 7:
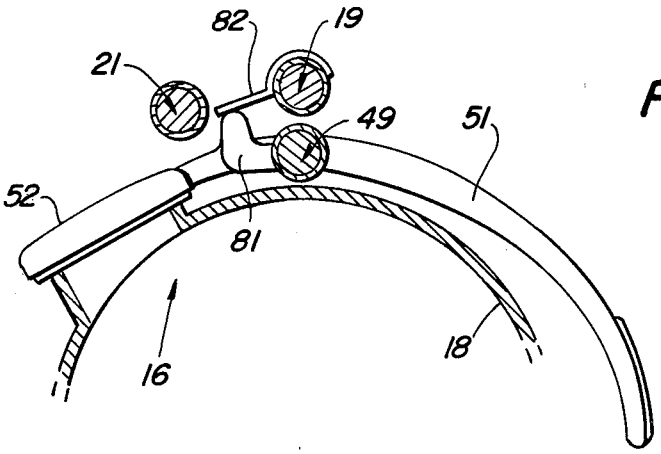
FIG. 7 is an enlarged, fragmentary cross sectional view taken along line 7—7 of FIG. 5, showing A flat-B flat trill facilitator mechanism.

The facilitator assembly 16 can include a cam 81 which has been moved from the G sharp key 52 arm and fixed to the supplementary support rod and sleeve assembly 49 (FIG. 7). The plate 82 is fixed to assembly 19 as before, but moved toward the right hand B flat lever 39 to remain directly over the cam 81.

The components of the facilitator invention 13 are formed of materials commonly employed in the construction of flutes, by metal working techniques well known to those skilled in the art.

When the B flat lever 33 is depressed by the left hand thumb, the B flat key 37 moves downwardly to close its associated tone hole, the same result as in the standard Boehm flute and fingering system. The foot 53 is moved away from the tube 18, engaging the rocker bar 54. This causes the rocker bar 54 to tilt, the up-flute or flange 58 end thereof moving away from the tube 18. The curved support 59 thereby is rotated away from the tube 18, and the assembly 19 rotates the B flat key 37 onto the tone hole.

When the A key 38 is depressed, as by the left hand middle finger, the B flat key 37 moves downwardly to close its associated tone hole, again the same result as in the standard Boehm flute fingering system. The foot 38*a* of the A key 38 engages the rocker bar 54, between the foot 53 and flange 58 end, causing the same aforementioned tilting of the rocker bar 54.

When the G key 44*a* is depressed, as by the left hand ring finger, the B flat key 37 is not actuated, the tone hole remaining open. Again, this is the same result as in the standard Boehm flute fingering system. The G key foot extension 63 rotates the member 64 away from the tube 18, toward assembly 21. The rocker bar 54 tilts, the down-flute end thereof elevated by the pivot 66. The rocker bar 54 lifts off the foot 53 and pivots at 61, but, as the only pressure at 61 is down, against the tube 18, the lever 59, and consequently the B flat key 37, is not actuated.

When high F sharp or high B natural is to be played following actuation of the B flat key 37 by the B flat lever 33, the left hand thumb does not have to be moved to the B natural lever 31. Because lever 33 is depressed, the foot 53 is elevated, and the rocker bar 54 remains engaged by the foot 53. Depression of the G key 44*a* again causes extension 63 to lift member 64. The down-flute end of the rocker bar 54 is elevated, and the up-flute or flange 58 end of the rocker bar 54 is depressed, the rocker bar 54 pivoting or "teetering" on the foot 53. The pivot 61 is driven toward the tube 18, causing the curved support lever 59 and assembly 19 to lift the B flat key 37 from the tone hole. High F sharp or high B natural thereby is facilitated, and a particularly troublesome fingering of the standard system eliminated. When the G key 44*a* is released, its stronger biasing spring facilitates the return of the B flat key 37 to a closed position and the "tottering" of the rocker bar 54 on the foot 53 back such that the up-flute end is elevated and the down-flute end depressed again, the spring 74 performing this function for the in-line flute 12.

The A flat-B flat trill is retained. Depression of the G sharp lever 46, as by the left hand little finger, lifts the G sharp key 47 from its tone hole. The cam 67 on the G sharp key 47 arm is elevated and engages the plate 68. The assembly 19 thereby is actuated to close the B flat key 37 onto its tone hole. For the in-line flute 12, depression of the G sharp lever 51 rotates assembly 49, thereby rotating the cam 81 against plate 83 to effect the same result.

A first ratio, of the distance from the axis of the rod and sleeve assembly 19 or 23 (to which G key 48*a* or 44*a* respectively are hinged) to the axis of member 64, to the distance from pivot 66 to where the foot 53 engages rocker bar 54, is the same as a second ratio, of the distance from the axis of rod and sleeve assembly 19 (to which B flat key 37 is hinged) to the axis of pivot 61, to the distance from pivot 61 to where the foot 53 engages rocker bar 54. For the in-line flute 12, the foot 53 engages the middle of the rocker bar 54 underside. For the off-set flute 11, the foot 53 engages the rocker bar 54 away from the middle, toward the up-flute or flange 58 end.

The flange 58 and the spring 74 prevent axial rotation of rocker bar 54, facilitating proper action of the fingering mechanism at proper pressures. The normal biasing spring for the B flat key 37 in the in-line flute 12 is removed, its function of holding the key 37 in the normal up or open position being assumed by spring 74. Bias spring tension of the G key 48*a*, 48*b* may then be kept light.

Industrial Applicability

The usefulness of the facilitator invention 13 will be readily apparent to skilled flute players and teachers of the flute. A particularly troublesome fingering of the standard Boehm flute fingering system has been eliminated. The natural tendency of beginning flute players to leave the thumb on the B flat lever 33 has been accommodated. Playing high F sharp or high B natural, common in today's music, has been facilitated. All other finger movements of the Boehm system have been retained. The mechanism employed is readily constructed, durable, and fitted to the standard Boehm flute.

Although a preferred embodiment has been disclosed herein, various modifications and alternate constructions can be made without departing from the full scope of the invention defined in the claims.

We claim:

1. In a Boehm flute having a B flat key, Briccialdi B flat lever, G key and G sharp lever mounted on rod and sleeve assemblies, a facilitator mechanism for operating the B flat key comprising:

rocker arm means pivotally suspended between the Briccialdi B flat lever and the rod and sleeve assemblies bearing the B flat key and coupled between the B flat key and the G key;

foot means fixed to, extending from, and movable by operation of, the Briccialdi B flat lever to engage and tilt said rocker arm means in a first direction for moving the B flat key from open to closed position; and said rocker arm means being movable by operation of the G key to tilt in a second direction for moving the B flat key from closed to open position if the Briccialdi B flat lever is being operated.

2. The mechanism of claim 1 and further including third means coupling the B flat key and G sharp lever.

3. The mechanism of claim 2 and further wherein said third means includes a plate coupled to the B flat key and a cam coupled to the G sharp lever and movable into engagement with said plate by operation of the G sharp lever.

4. The mechanism of claim 1 and further wherein the G key has a foot extension below the rod and sleeve assemblies to the side thereof of the Briccialdi B flat lever, a bearing member is fixed to said foot extension, said rocker means being mounted at said bearing member.

5. In a Böehm flute having a B flat key, Briccialdi B flat lever, G key and G sharp lever mounted on rod and sleeve assemblies, a facilitator mechanism for operating the B flat key comprising:

rocker arm means pivotally coupled between the B flat key and the G key;

foot means extending from, and movable by operation of, the Briccialdi B flat lever to engage and tilt said rocker arm means in a first direction for moving the B flat key from open to closed position; and a lever has a first end fixed to the rod and sleeve assembly bearing the B flat key and a second end bearing said rocker arm means, a flat portion is formed on said second end, and a flange is formed on said rocker arm means and engages said flat portion, said rocker arm means being movable by operation of the G key to tilt in a second direction for moving the B flat key from closed to open position if the Briccialdi B flat lever is being operated.

6. In a Böehm flute having a B flat key, Briccialdi B flat lever, G key and G sharp lever mounted on rod and sleeve assemblies, a facilitator mechanism for operating the B flat key comprising:

rocker arm means pivotally coupled between the B flat key and the G key;

foot means extending from, and movable by operation of, the Briccialdi B flat lever to engage and tilt said rocker arm means in a first direction for moving the B flat key from open to closed portion;

said rocker arm means being movable by operation of the G key to tilt in a second direction for moving the B flat key from closed to open position if the Briccialdi B flat lever is being operated; and spring means, extending from the Briccialdi B flat lever to said rocker arm means, for biasing and preventing axial rotation of said rocker arm means.

7. The mechanism of claim 6 and further wherein said foot means and spring means engage opposite sides of said rocker arm means.

* * * * *